US007642972B1

(12) United States Patent
Yu et al.

(10) Patent No.: US 7,642,972 B1
(45) Date of Patent: Jan. 5, 2010

(54) ANTENNA

(75) Inventors: Chao-Hui Yu, Tu-Cheng (TW); Hung-Jen Chen, Tu-Cheng (TW); Yu-Yuan Wu, Tu-Cheng (TW); Chih-Kuo Wang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 15 days.

(21) Appl. No.: 12/176,652

(22) Filed: Jul. 21, 2008

(51) Int. Cl.
*H01Q 1/24* (2006.01)

(52) U.S. Cl. ..... 343/702; 455/575.7

(58) Field of Classification Search ..... 343/700 MS, 343/702, 846; 455/575.7
See application file for complete search history.

(56) References Cited

U.S. PATENT DOCUMENTS 5,483,249 A * 1/1996 Kennedy ..... 343/846
5,926,139 A * 7/1999 Korisch ..... 343/702
6,140,966 A * 10/2000 Pankinaho ..... 343/700 MS
6,252,552 B1 * 6/2001 Tarvas et al. ..... 343/700 MS
6,552,686 B2 * 4/2003 Ollikainen et al. .... 343/700 MS
6,650,295 B2 * 11/2003 Ollikainen et al. .... 343/700 MS
6,650,298 B2 * 11/2003 Abbasi et al. ..... 343/702
6,806,834 B2 * 10/2004 Yoon ..... 343/702
6,876,329 B2 * 4/2005 Milosavljevic ..... 343/700 MS
7,126,546 B2 * 10/2006 Annamaa et al. ..... 343/702
7,199,761 B2 * 4/2007 Martinez et al. ..... 343/702

* cited by examiner

*Primary Examiner*—Michael C Wimer

(57) ABSTRACT

An antenna includes a first radiating conductor and a second radiating conductor. The first radiating conductor defines a first edge, a second edge and a lateral edge connecting the first edge and the second edge. The second radiating conductor has a main body spaced away from the second edge and connected to an end of the first radiating conductor far away from the lateral edge by a first connecting portion and extending towards the lateral edge. A free end of the main body bends to the second edge to form a second connecting portion spaced away from the lateral edge. A radiating end bends oppositely to the first radiating conductor from an end of the second connecting portion and is adjacent to the second edge. A feeding conductor and a grounding conductor are connected to an edge of the first radiating conductor different from the first edge and the lateral edge.

7 Claims, 3 Drawing Sheets

ANTENNA

BACKGROUND OF THE INVENTION

1. Field of the Invention

The present invention relates to an antenna, and more particularly to an antenna with anti-interference characteristic for use in a portable electrical device.

2. The Related Art

With the rapid development of wireless communication technologies, portable electrical devices used in wireless communication, such as mobile phone, wireless personal digital assistant (PDA) and laptop computer, are developed and produced, and antennas employed in the respective portable electrical devices are main parts to give influence to the wireless communication performance of the portable electrical devices, especially in the portable electrical devices with small volume yet multifunction.

However, since a conventional antenna is mounted in a small space of a portable electrical device, the conventional antenna increases the vulnerability to the electromagnetic interference from the ambient environment, that is, the conventional antenna is easy to get influenced by neighbor electrical components, for example acoustic component. As a result, the resonant frequency of the conventional antenna is changed adversely or its radiation characteristic deteriorates and consequently, wireless communication quality of the portable electrical device falls seriously.

SUMMARY OF THE INVENTION

Accordingly, an object of the present invention is to provide an antenna which exhibits excellent anti-interference characteristic for use in a portable electrical device.

The antenna includes a first radiating conductor and a second radiating conductor. The first radiating conductor defines a first edge, a second edge opposite to the first edge and a lateral edge connecting the first edge and the second edge. The second radiating conductor has a main body spaced away from the second edge and connected to an end of the first radiating conductor far away from the lateral edge by a first connecting portion and extending towards the lateral edge. A free end of the main body bends to the second edge to form a second connecting portion spaced away from the lateral edge. A radiating end bends oppositely to the first radiating conductor from an end of the second connecting portion and is adjacent to the second edge. A feeding conductor and a grounding conductor are connected to an edge of the first radiating conductor different from the first edge and the lateral edge.

Another object of the present invention is to provide a wireless communication device including an antenna and an acoustic component, the antenna includes a first radiating conductor and a second radiating conductor. The first radiating conductor defines a first edge, a second edge opposite to the first edge and a lateral edge connecting the first edge and the second edge. The second radiating conductor has a main body spaced away from the first edge, the main body is connected to an end of the first radiating conductor far away from the lateral edge by a first connecting portion and extends towards the lateral edge, a free end of the main body bends to the second edge to form a second connecting portion spaced away from the lateral edge, a radiating end bends oppositely to the first radiating conductor from an end of the second connecting portion and is adjacent to the second edge. Wherein the acoustic component is surrounded by the radiating end and the second connecting portion. A feeding conductor and a grounding conductor are connected to an edge of the first radiating conductor different from the first edge and the lateral edge.

As described above, according to a first aspect of the present invention, the second radiating conductor used to receive electromagnetic signal of the low frequency band almost encircles the first radiating conductor used to receive electromagnetic signal of high-frequency band, that is, the first radiating conductor is separated away from other electrical devices arranged therearound via the second radiating conductor, which can reduce the high-frequency interference between the antenna and other electrical devices. According to a second aspect of the present invention, the wireless communication device with the antenna and acoustic component mounted therein is improved the wireless communication quality because of the acoustic component surrounded by the radiating end and the second connecting portion so as to reduce the high-frequency interference between the antenna and acoustic component.

BRIEF DESCRIPTION OF THE DRAWINGS

The present invention will be apparent to those skilled in the art by reading the following description of embodiments thereof, with reference to the attached drawings, in which.

DETAILED DESCRIPTION OF THE EMBODIMENTS

Figure 1:
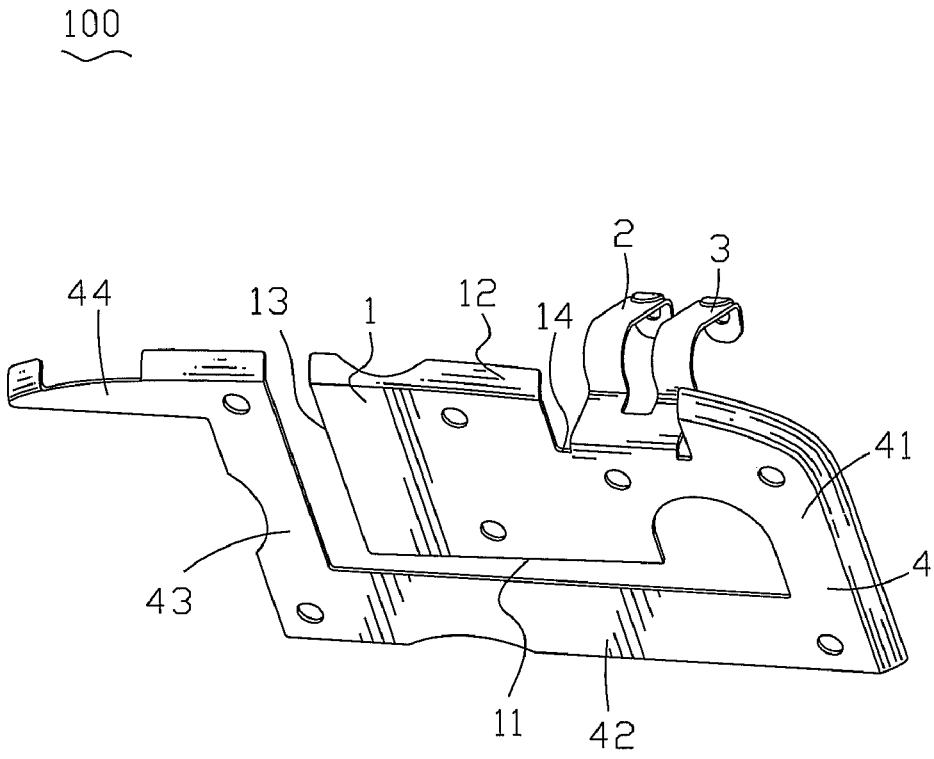
FIG. 1 shows a first embodiment of an antenna according to the present invention.

With reference to FIG. 1, a first embodiment of an antenna 100 according to the present invention is shown. The antenna 100 has a first radiating conductor 1. The first radiating conductor 1 is of a planar sheet and defines a first edge 11, a second edge 12 opposite to the first edge 11 and a lateral edge 13 connecting the first edge 11 and the second edge 12. The second edge 12 defines a notch 14. A feeding portion 2 and a grounding portion 3 extend outwardly from a bottom side of the notch 14 to show hook-shape.

Please refer to FIG. 1, the first radiating conductor 1 is connected to a second radiating conductor 4 which has a first connecting portion 41 extending outwardly from an upper portion of an end of the first radiating conductor 1 opposite to the lateral edge 13 and bending toward the first edge 11. A free end of the first connecting portion 41 bends towards the first radiating conductor 1 and extends to form a main body 42. The main body 42 is parallel to the first edge 11 and is spaced away from the first edge 11 with a predetermined distance. A free end of the main body 42 bends to the second edge 12 to form a second connecting portion 43. The second connecting portion 43 is spaced away from the lateral edge 13. A free end of the second connecting portion 43 bends oppositely to the first radiating conductor 1 and extends to form a radiating end 44 adjacent to the second edge 12. In this embodiment, the radiating end 44 is flush with the second edge 12, and the second radiating conductor 4 is on the same plane as the first radiating conductor 1.

When the antenna 100 is mounted in a portable electrical device, the first radiating conductor 1 is capable of receiving electromagnetic signal of the high-frequency band, while the second radiating conductor 4 is capable of receiving electromagnetic signal of the low-frequency band.

Figure 2:
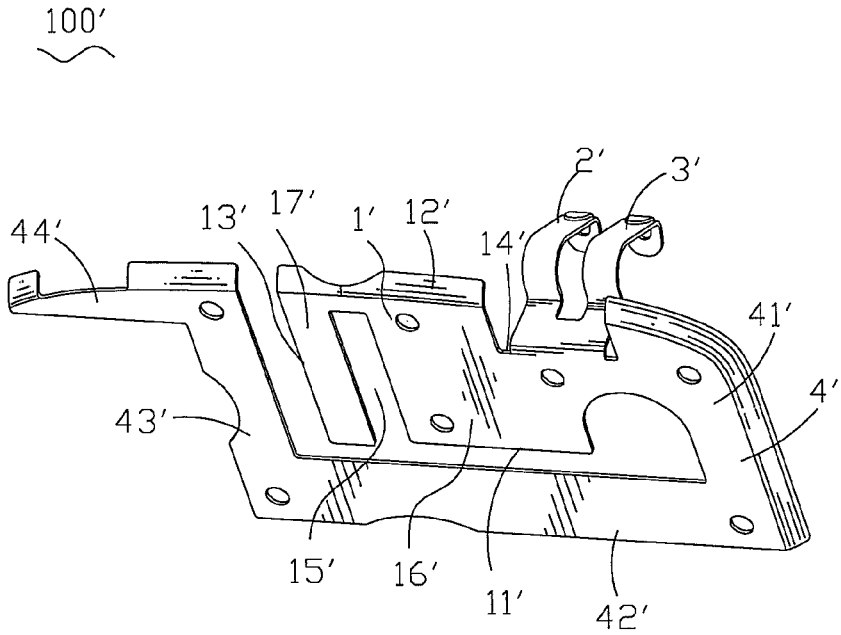
FIG. 2 illustrates a second embodiment of the antenna according to the present invention.

Referring to FIG. 2, an antenna 100' in accordance with a second embodiment of the present invention is illustrated. In comparison with the first embodiment of the present invention, the structure of the antenna 100' is same as that of the antenna 100 except for a first radiating conductor 1'. The first radiating conductor 1' is cut to form a slot 15' passing through the first edge 11' to divide the first radiating conductor 1' into a first radiating portion 16' and a second radiating portion 17' adjacent to the second connecting portion 43'. The second radiating portion 17' is a strip-shape and parallel to the second connecting portion 43'. In this embodiment, the second radiating portion 17' is spaced away from the second connecting portion 43' with a predetermined distance.

When the antenna 100' is used in a portable electrical device, the second radiating conductor 4' is adapted to receive the electromagnetic signal of the low-frequency band, while the second radiating portion 17' is used to receive the electromagnetic signal of the high-frequency band.

Figure 3:
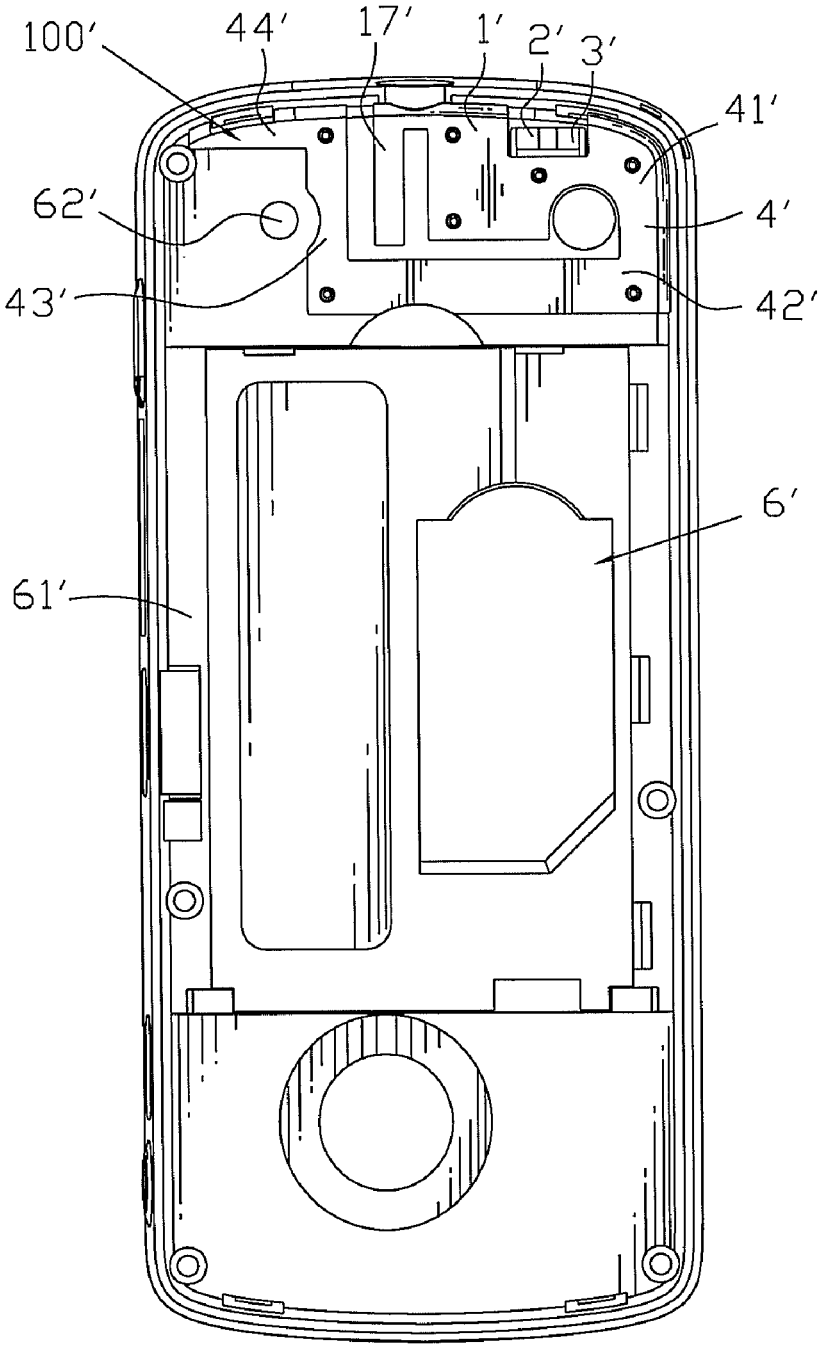
FIG. 3 is a perspective view illustrating an example illustrating application of the antenna in FIG. 2 in a mobile phone.

FIG. 3 is a perspective view showing the antenna 100' mounted in a mobile phone 6'. The mobile phone 6' has a shell 61' with a printed circuit board (not shown) fixed therein. An acoustic component 62' is fixed in the printed circuit board. The antenna 100' is mounted in the shell 61', with the feeding portion 2' and the grounding portion 3' connected to the printed circuit board. The second connecting portion 43' and the radiating end 44' are arranged to partly encircle the acoustic component 62' and are spaced away from the acoustic component 62' with a predetermined distance. Thus the acoustic component 62' is adjacent to the second radiating conductor 4' and separated away from the second radiating portion 17', which can reduce the high-frequency interference between the antenna 100' and the acoustic component 62' and consequently, the wireless communication quality is greatly improved.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An antenna, comprising:

a first radiating conductor defining a first edge, a second edge opposite to the first edge and a lateral edge connecting the first edge and the second edge together;

a second radiating conductor having a main body spaced away from the first edge, the main body being connected to an end of the first radiating conductor far away from the lateral edge by a first connecting portion and extending towards the lateral edge, a free end of the main body bending to the second edge to form a second connecting portion spaced away from the lateral edge, a radiating end bending oppositely to the first radiating conductor from an end of the second connecting portion and adjacent to the second edge;

a feeding conductor connected to an edge of the first radiating conductor different from the first edge and the lateral edge; and a grounding conductor connected to an edge of the first radiating conductor different from the first edge and the lateral edge.

2. The antenna as claimed in claim 1, wherein the first radiating conductor is cut to from a slot passing through the first edge to divide the first radiating conductor into a first radiating portion and a second radiating portion adjacent to the second connecting portion.

3. The antenna as claimed in claim 2, wherein the second radiating portion is a strip-shape extending towards the main body of the second radiating conductor.

4. The antenna as claimed in claim 2, wherein the feeding conductor and the grounding conductor are both connected to the first radiating portion.

5. The antenna as claimed in claim 1, wherein the feeding conductor and the grounding conductor are connected to the second edge of the first radiating portion and are close to each other.

6. The antenna as claimed in claim 5, wherein the second edge defines a notch, and the feeding portion and the grounding portion extends outwardly from a bottom side of the notch to show hook-shaped.

7. A wireless communication device, comprising an antenna and acoustic component, the antenna comprising:

a first radiating conductor defining a first edge, a second edge opposite to the first edge and a lateral edge connecting the first edge and the second edge;

a second radiating conductor having a main body spaced away from the first edge, the main body being connected to an end of the first radiating conductor far away from the lateral edge by a first connecting portion and extending towards the lateral edge, a free end of the main body bending to the second edge to form a second connecting portion spaced away from the lateral edge, a radiating end bending oppositely to the first radiating conductor from an end of the second connecting portion and adjacent to the second edge, wherein the acoustic component is surrounded by the radiating end and the second connecting portion;

a feeding conductor connected to an edge of the first radiating conductor different from the first edge and the lateral edge; and a grounding conductor connected to an edge of the first radiating conductor different from the first edge and the lateral edge.

* * * * *